US005871169A

United States Patent [19]

Hasegawa

[11] Patent Number: 5,871,169

[45] Date of Patent: Feb. 16, 1999

[54] PHOTOGRAPHIC FILM WITH RETAINER PORTION CUT ALONG PERFORATION EDGE

[75] Inventor: Koji Hasegawa, Kanagawa, Japan

[73] Assignee: Fuji Photo Film Co., Ltd., Kanagawa, Japan

[21] Appl. No.: 788,778

[22] Filed: Jan. 24, 1997

[30] Foreign Application Priority Data

Jan. 26, 1996 [JP] Japan ..... 8-011948

[51] Int. Cl.[6] ..... B65H 35/08

[52] U.S. Cl. ..... 242/526.3; 242/348.1; 242/584.1; 242/587.1

[58] Field of Search ..... 242/526.3, 348, 242/348.1, 348.4, 532.1, 532.6, 587.1, 584.1; 396/415, 511, 512, 514, 652; 428/43

[56] References Cited

U.S. PATENT DOCUMENTS

| | | | |
|---|---|---|---|
| 3,021,085 | 2/1962 | Freer | 242/587.1 |
| 3,115,417 | 12/1963 | Christensen | 428/43 |
| 4,275,855 | 6/1981 | Wakabayashi | 242/584.1 X |
| 4,609,163 | 9/1986 | Kimura et al. | 242/584.1 X |
| 4,735,437 | 4/1988 | Fattibene | 428/43 X |
| 4,852,821 | 8/1989 | Harris et al. | 242/584.1 |
| 5,125,630 | 6/1992 | Hoyt et al. | 242/526.3 X |
| 5,295,635 | 3/1994 | Niedospial, Jr. et al. | 242/584.1 |
| 5,351,904 | 10/1994 | Mitake | 242/584.1 |
| 5,487,513 | 1/1996 | Takahashi et al. | 242/348.1 |

FOREIGN PATENT DOCUMENTS

| | | | |
|---|---|---|---|
| 728251 | 11/1942 | Germany | 242/587.1 |

*Primary Examiner*—Donald P. Walsh
*Assistant Examiner*—William A. Rivera
*Attorney, Agent, or Firm*—Sughrue, Mion, Zinn, Macpeak & Seas, PLLC

[57] ABSTRACT

A photo filmstrip has plural perforations arranged along each of lateral edges and at a regular interval. A trailer is retained to a spool to be wound about the spool in a roll form. A retainer portion is formed at a smaller width by cutting each of the lateral edges along a first line being substantially perpendicular to the lateral edges, and by cutting the trailer along second and third lines being substantially parallel to the lateral edges. The retainer portion is adapted to be retained on the spool. The first line lies on one side of one of the perforations having been arranged before forming the retainer portion along the lateral edges.

14 Claims, 11 Drawing Sheets

PHOTOGRAPHIC FILM WITH RETAINER PORTION CUT ALONG PERFORATION EDGE

BACKGROUND OF THE INVENTION

1. Field of the Invention

The present invention relates to a photographic film. More particularly, the present invention relates to a photographic film which is wound about a spool and contained in a photo film cassette.

2. Description Related to the Prior Art

Photographic film of the 135 type has two trains of perforations arranged along respective lateral edges and at a regular pitch, and contained in a cassette shell of a photo film cassette having light shielding capacity. A trailer of the photo film is connected to a spool in the cassette shell, and is contained in the cassette shell after winding the photo film in a roll form.

In FIG. 8, a trailer of a photo filmstrip 102 is illustrated. Perforations 4 are arranged at a regular pitch P. A trailer of the photo filmstrip 102 has a retainer portion 103, which is narrower than the remaining portion of the photo filmstrip 102. The retainer portion 103 has a length A and a width W. To define the length A of the retainer portion 103, lateral edges are cut along a first line 120 being perpendicular to the lateral edges. The first line 120 has a position lying between the perforations 4. To define the width W of the retainer portion 103, the trailer is cut along second and third lines 121*a* and 121*b* being parallel to the lateral edges.

Two retaining holes 3*a* are formed in the retainer portion 103. When the retainer portion 103 is inserted in a slot 6 in a spool core 5, retaining claws 7 inside the slot 6 are engaged with the retaining holes 3*a*. Then the trailer is connected to the spool core 5, which is rotated in orienting the emulsion surface toward the spool core 5. The photo filmstrip 102 is wound on the spool core 5 in a roll form between flanges 5*a*.

In FIG. 9, continuous photo film 8 for producing the photo filmstrip 102 is illustrated. When the continuous photo film 8 is conveyed in the direction of the arrow at an amount as much as predetermined, the continuous photo film 8 is stopped and a cutter or trimmer is operated for forming a leader of a preceding photo filmstrip 102*a* and the trailer of the photo filmstrip 102 of FIG. 8, while eliminating a waste of the photo film. A pair of retaining holes 3*a* are formed by the cutter at the same time.

In the photo filmstrip 102, the first line 120 has a position between the perforations. In FIG. 8, the photo filmstrip 102 meets $t2<t$, where t is an interval between the perforations 4, and t2 is an interval between the first line 120 and one of the perforations 4 the closest to the end of the trailer. A shape of the cutter for shaping both the trailer of the photo filmstrip 102 and the leader of the photo filmstrip 102*a* is determined by considering the position of the first line 120.

The photo filmstrip 102 about the spool core 5 is contained in a cassette shell light-tightly (See FIGS. 3 and 4). Initially the leader of the photo filmstrip 102 is protruded from a photo film passage port. To load a camera with the photo filmstrip 102, the leader is manually picked and pulled as much as required. An end of the leader is fitted on a take-up spool of the camera. If a camera having an auto-loading mechanism is used, the leader end is placed near to the take-up spool suitably.

A user may rotate the spool core 5 opposite to a direction of photo film winding, with incidental intention to draw out the leader as much as required. If the leader is drawn out longer than required, the spool core 5 can be rotated in the winding direction for the purpose of winding back a surplus portion of the leader. If the user is unaccustomed to the use of the photo film cassette, he or she is likely to rotate the spool core 5 opposite to the winding direction. As the leader of the photo filmstrip 102 is in frictional contact with light-trapping fabric in the passage port, the roll of the photo filmstrip 102 becomes loosened inside the cassette about the spool core 5 being rotated. A gap L is formed between the spool core 5 and an innermost one of the turns of the photo filmstrip 102 (See FIG. 6).

The spool core 5 is rotated further in the direction opposite to the direction of winding of the photo filmstrip 102. A portion of the photo filmstrip 102 protruded from the slot 6 is pressed by force in a direction of orienting the emulsion surface convexly. A point H lying on the first line 120 is indicated in FIG. 10A. The portion at the point H is pushed by an open edge of the slot 6, so that the photo filmstrip 102 receives strong force in the opposite rotational direction inside the gap L (See FIG. 6).

The photo filmstrip 102 kept in the roll form has the irresistible tendency of maintaining a curl in a longitudinal direction. The photo filmstrip 102 also has a curling tendency in a width direction, like an archway. Upon application of the force in the opposite rotational direction against the curling tendency of the innermost turn of the photo filmstrip 102, the portions at the first line 120 flex or bend as illustrated in FIG. 10B. Stress occurs in directions of the arrows in the drawing at the perforations 4. The photo filmstrip 102 is likely to break from a corner of one of the perforations 4 along the broken line indicated in the drawing, only upon small reverse rotation of the spool core 5 with occurrence of the gap L (See FIG. 6).

The gap L is unfavorable especially when small. As an outer shape of the cassette shell is unchanged, the gap L depends on the length of the photo filmstrip 102. FIG. 11 is a graph of a condition of breakage of the photo filmstrip 102 upon reverse winding of the photo filmstrip 102 having the above-described shape. In the graph, a horizontal axis is determined to take the available frame number of the photo filmstrip 102, or the maximum number of frames photographable to the photo filmstrip 102. A right-hand vertical axis is determined to take bending force BF (in grams) applied to the innermost turn of the photo filmstrip 102 in the opposite rotational direction. A left-hand vertical axis is determined mined to take the gap L (in mm). The photo filmstrip 102 has the interval t2=0.5 mm, and thickness of 142 $\mu$m. Specific features of the photo filmstrip 102 are as follows:

Tear strength: 30 g/cm$^2$ in the longitudinal direction; and 45 g/cm$^2$ in the width direction;

Modulus of elasticity: 590 kgf/mm$^2$ in the longitudinal direction; and 420 kgf/mm$^2$ in the width direction;

Elongation: 36% in the longitudinal direction; and 32% in the width direction.

A linear velocity of rotation for reverse winding of the photo filmstrip 102 is 500 mm/sec.

It was observed in FIG. 11 that the gap L decreased according to an increase of the available frame number, and that the bending force BF increases according to the increase of the available frame number. If the photo filmstrip 102 has the gap L being small due to smallness of the available frame number, it is difficult for the photo filmstrip 102 to bend back upon reverse rotation of the spool core 5, so that the bending force BF applied to the photo filmstrip 102 is great. The greatness of the bending force BF is remarkable when the photo filmstrip 102 has the available frame number as great as 31–33 frames. Approximately 20% or more of the photo filmstrip 102 of this length are broken and become unusable. The bending force BF is much greater if the photo filmstrip 102 has the available frame number as great as 34–36 frames. Approximately 70% or more of the photo filmstrip 102 of this length are broken.

Likeliness of breakage of the photo filmstrip 102 upon reverse bend of the photo filmstrip 102 increases according to the smallness of the gap L and thus a great length of the photo filmstrip 102. This likeliness is more conspicuous under low temperature which heightens rigidity of a support material of the photo filmstrip 102, or if the support material has characteristically high rigidity irrespective of the environment. The photo filmstrip 102 is disconnected from the spool core 5 to make it impossible to use the photo film cassette any longer, because the photo filmstrip 102 cannot be developed in the photo film processor even after incidental success of taking exposures to the photo filmstrip 102 in the camera.

SUMMARY OF THE INVENTION

In view of the foregoing problems, an object of the present invention is to provide a photographic film which is wound about a spool and contained in a photo film cassette, and is prevented from being broken away from the spool even upon inadvertent reverse rotation of the spool.

In order to achieve the above and other objects and advantages of this invention, a photo filmstrip has plural rectangular perforations arranged along each of lateral edges and at a regular interval. The photo filmstrip is wound about a spool in a roll form with a trailer thereof wound inwards. The photo filmstrip has a retainer portion adapted to retention on the spool, formed at a smaller width like a tongue, by cutting the lateral edges of the trailer in an L-shape along first, second and third lines. The first line is substantially perpendicular to the lateral edges. The second and third lines are substantially parallel to the lateral edges. The first line lies on one of the perforations having been arranged before forming the retainer portion along the lateral edges.

The retainer portion is retained in insertion into a slot formed in the spool to extend in an axial direction.

In a preferred embodiment, two corners are defined between the first line and the lateral edges, and are cut down along fourth and fifth lines being inclined respectively with respect to the lateral edges with a decrease in a width of the trailer toward the first line.

Furthermore the width of the retainer portion is increased toward the first line.

In accordance with the present invention, the photographic film is reliably prevented from being broken away from the spool even upon inadvertent reverse rotation of the spool.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1B:
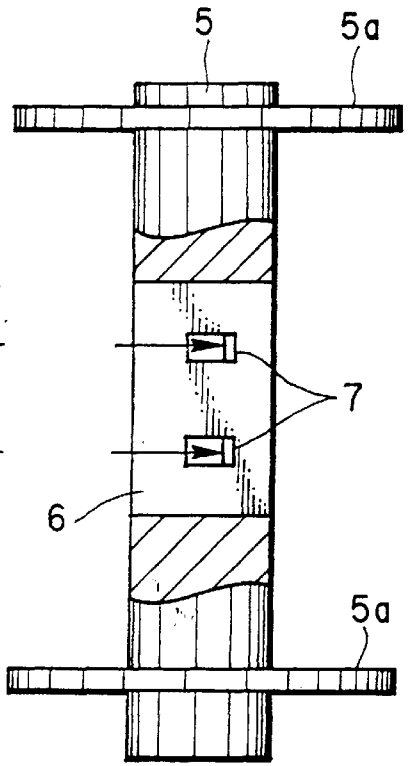
FIG. 1 is a plan, partially cut away, illustrating a trailer of a photo filmstrip with a spool.
Figure 1A:
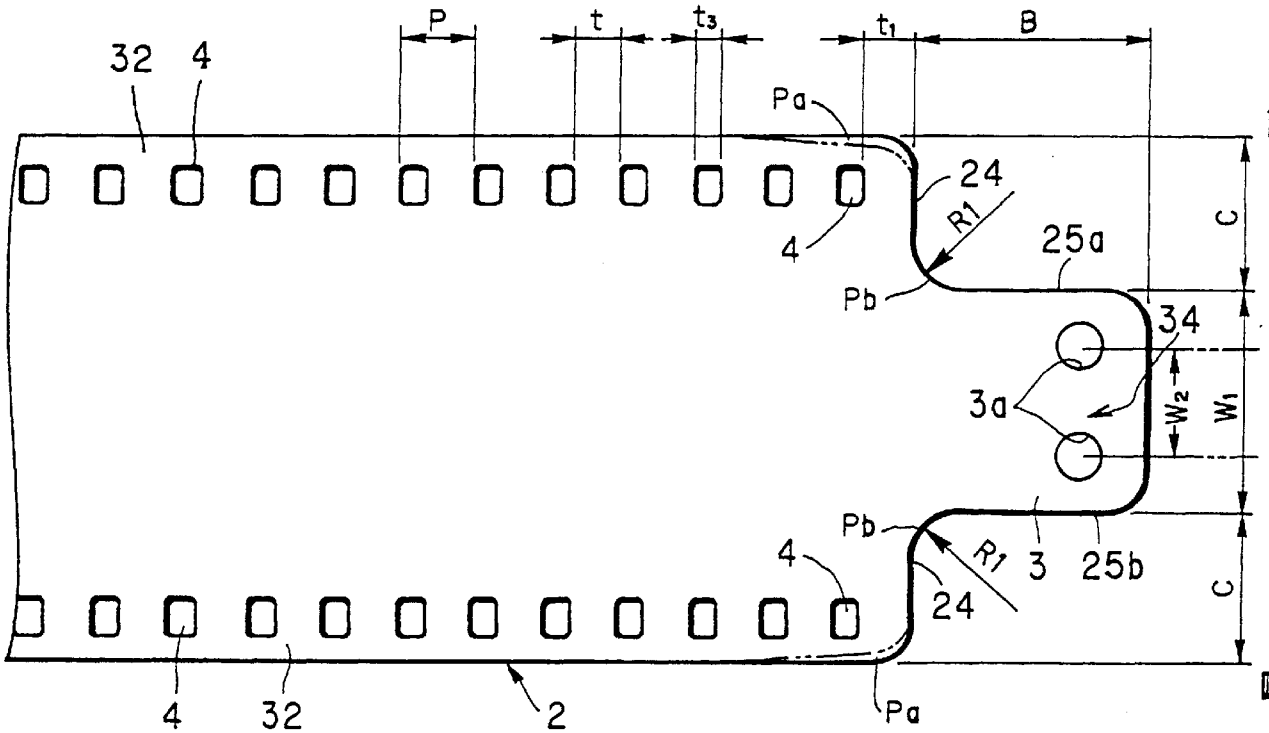

In FIG. 1, a trailer of a photo filmstrip 2 is illustrated, as viewed for an emulsion surface. A trailer 34 of the photo filmstrip 2 has a retainer portion 3, which is formed narrower than the remaining portion of the photo filmstrip 2. The retainer portion 3 has a length B and a width W1. To define the length B of the retainer portion 3, lateral edges 32 are cut along a first line 24 being perpendicular to the lateral edges 32. To define the width W1 of the retainer portion 3, the trailer 34 is cut along second and third lines 25*a* and 25*b* being parallel to the lateral edges 32. There are perforations 4 formed along the lateral edges 32 at a regular pitch P.

In the photo filmstrip 2, the first line 24 has a position lying on a side of one of the perforations. In FIG. 1, the photo filmstrip 2 meets t1=t, where t is an interval between the perforations 4, and t1 is an interval between the first line 24 and one of the perforations 4 the closest to the end of the trailer 34

There are two retaining holes 3*a* formed in the retainer portion 3. When the retainer portion 3 is inserted in a slot 6 in a spool core 5, retaining claws 7 inside the slot 6 are engaged with the retaining holes 3*a*. Then the trailer 34 is connected to the spool core 5, which is rotated in orienting the emulsion surface toward the spool core 5. The photo filmstrip 2 is wound on the spool core 5 in a roll form between flanges 5*a*. Details of the spool core 5 are described in the commonly assigned U.S. Pat. No. 5,487,513.

The photo filmstrip 2 is symmetrically formed relative to a longitudinal line passing a center of the photo filmstrip 2. Dimensions of the photo filmstrip 2 are as follows: t3=2 mm, t=2.8 mm, t1=2.8 mm, B=13 mm, W1=15 mm, W2=8 mm, and C=10 mm, where t3 is a width of each of the perforations 4, B is the length of the second and third lines 25*a* and 25*b*, W1 is a width of the retainer portion 3, W2 is an interval between centers of the retaining holes 3*a*, and C is a length of each segments of the first line 24.

Figure 2:
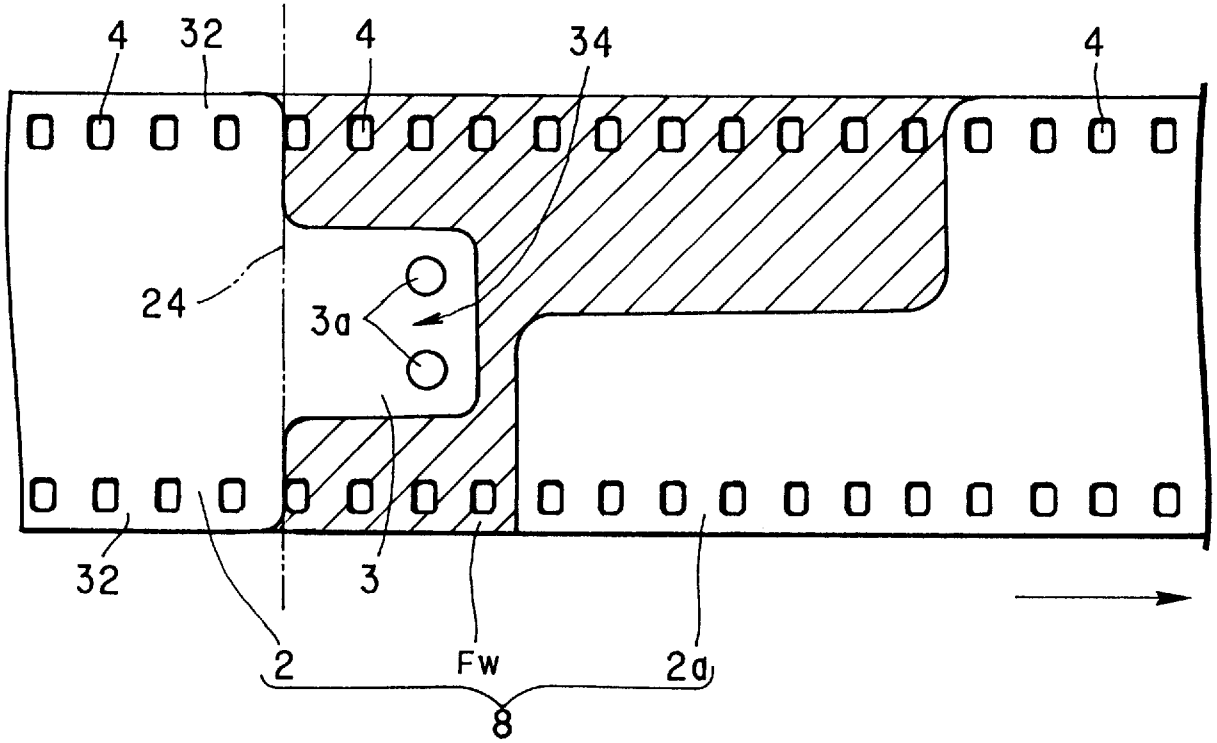
FIG. 2 is a plan illustrating continuous photo film from which the trailer of the photo filmstrip is cut.

In FIG. 2, continuous photo film 8 for producing the photo filmstrip 2 is illustrated. When the continuous photo film 8 is conveyed in the direction of the arrow at an amount as much as predetermined for a photo film size, the continuous photo film 8 is stopped and a cutter or trimmer is operated for forming a leader of a preceding photo filmstrip 2*a* and the trailer of the photo filmstrip 2 while eliminating a waste FW of the photo film. The first line 24 as edges of the trailer is located to lie on one of sides of the the perforations 4 which is farther from the end of the trailer 34. A pair of retaining holes 3*a* are formed by the cutter at the same time.

Figure 3:
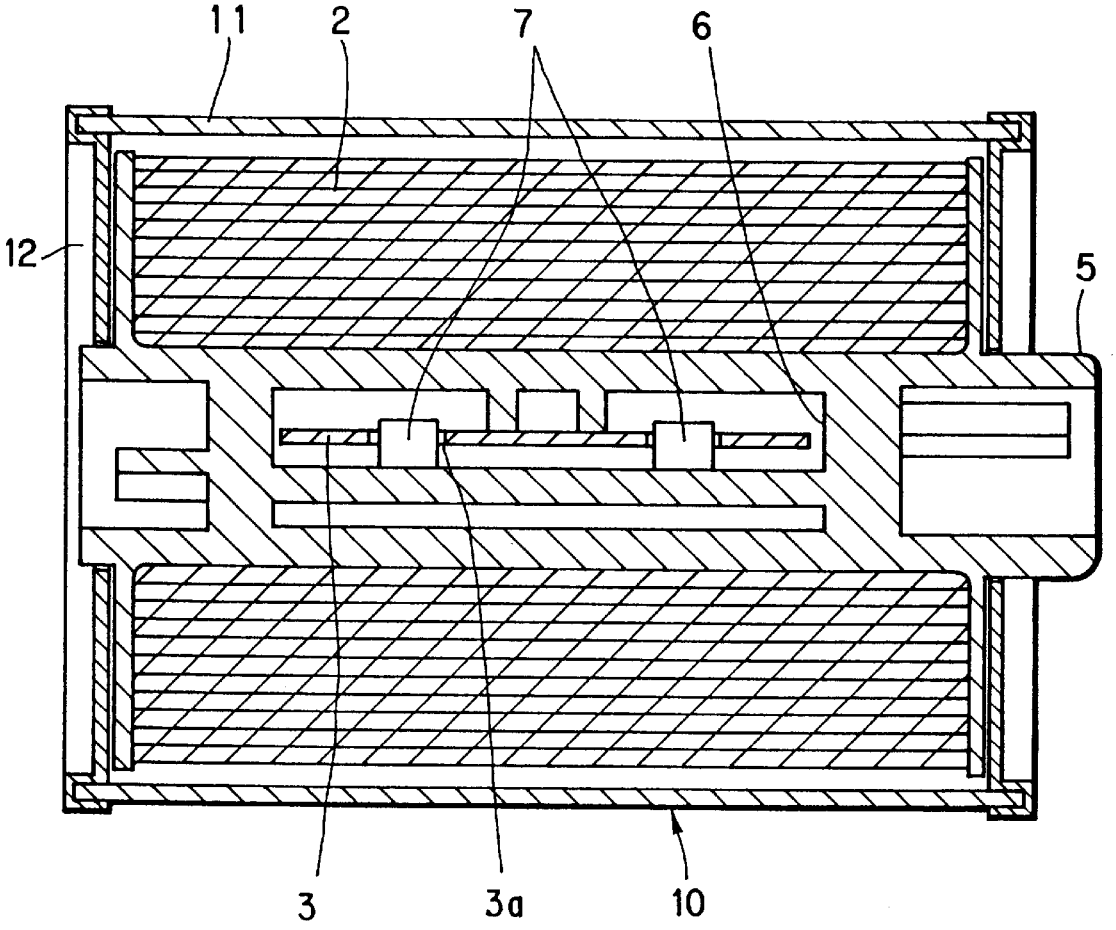
FIG. 3 is a longitudinal section illustrating a photo film cassette.
Figure 4:
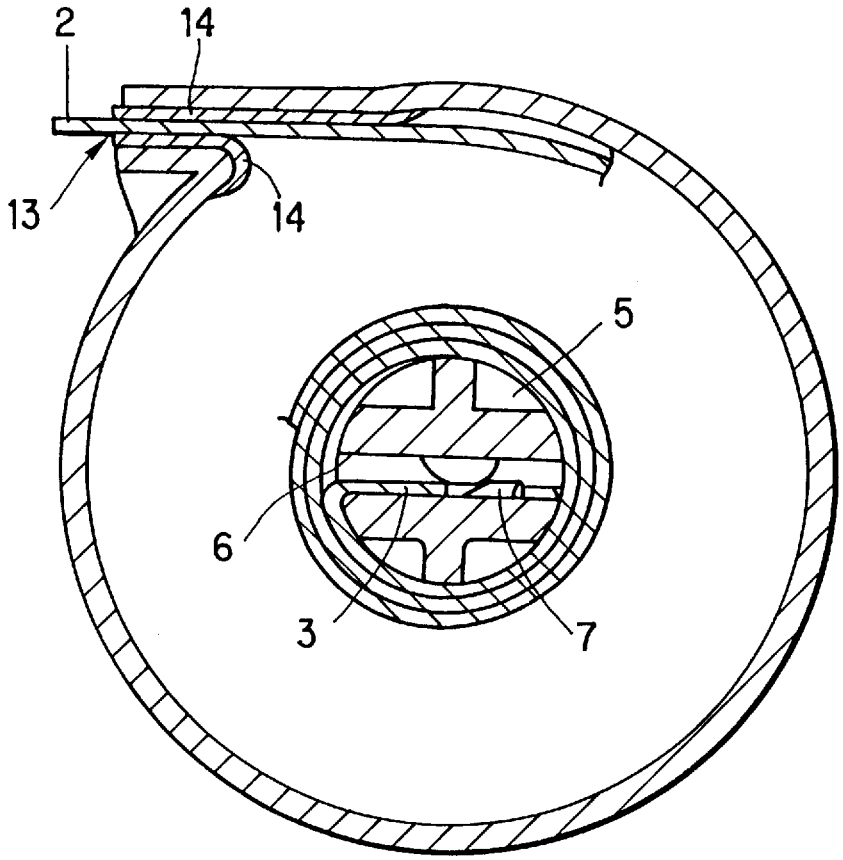
FIG. 4 is a cross section illustrating the photo film cassette.

In FIGS. 3 and 4, the photo filmstrip 2 about the spool core 5 is contained in a cassette shell 10 having light shielding performance. The cassette shell 10 includes a metal thin body plate 11 rolled cylindrically, and two caps 12 fitted on distal ends of the roll of the body plate 11. A photo film passage port 13 is defined in the roll of the body plate 11. A light-trapping fabric 14 is disposed in the photo film passage port 13.

The operation of the photo film cassette is described now. Initially the leader of the photo filmstrip 2 is protruded from the photo film passage port 13 at a predetermined length. To load a camera with the photo filmstrip 2, the leader of the photo filmstrip 2 is manually picked and pulled as much as required in the loading. An end of the leader is fitted on a take-up spool of the camera. If a camera having an auto-loading mechanism is used, the leader end is placed near to the take-up spool in a manner determined structurally.

A user may rotate the spool core 5 opposite to a direction of photo film winding, with incidental intention to draw out the leader as much as required. If the leader is drawn out longer than required, the spool core 5 can be rotated in the winding direction counterclockwise in FIG. 4 for the purpose of winding back a surplus portion of the leader. If the user is unaccustomed to the use of the photo film cassette, he or she is likely to rotate the spool core 5 opposite to the winding direction.

Figure 5A:
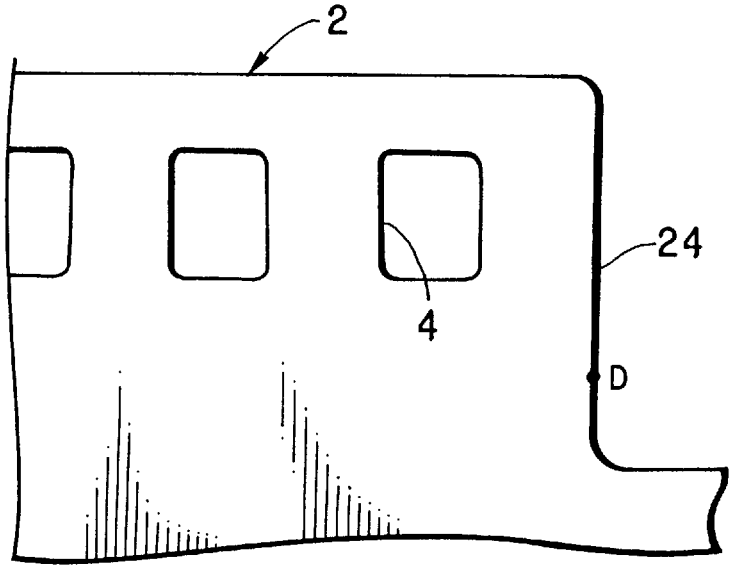
FIG. 5A is a partial plan illustrating a portion of the photo filmstrip at a first line for cutting.
Figure 6:
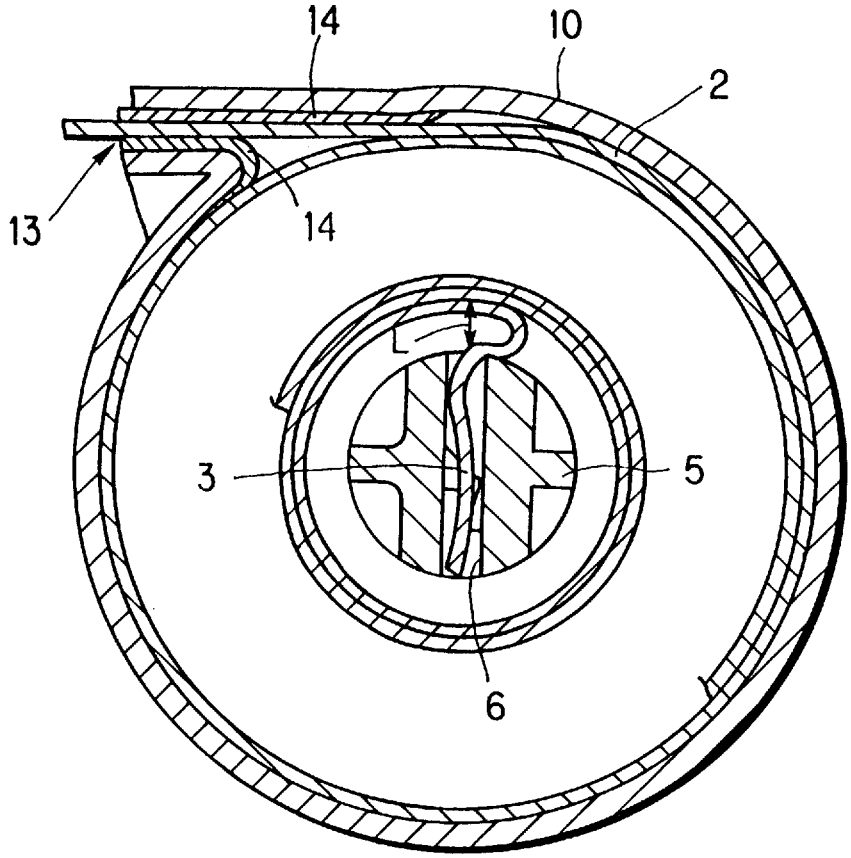
FIG. 6 is a cross section illustrating the photo film cassette of which the spool is rotated in reverse inadvertently.

In FIG. 6, a gap L is formed between the spool core 5 and an innermost one of the turns of the photo filmstrip 2. The spool core 5 is rotated further in the counterclockwise direction in FIG. 4, a portion of the photo filmstrip 2 protruded from the slot 6 receives application of force in a direction of orienting the emulsion surface convexly, opposite to the direction of winding of the photo filmstrip 2. A point D lying on the first line 24 is indicated in FIG. 5A. The portion at the point D receives push of an open edge of the slot 6, so that the photo filmstrip 2 receives strong force in the opposite rotational direction inside the gap L of FIG. 6.

Figure 5B:
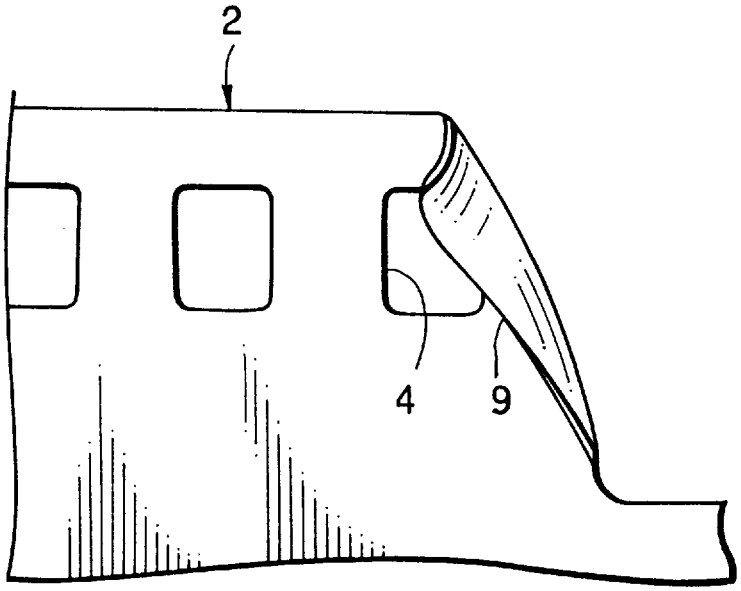
FIG. 5B is a partial plan illustrating the portion at the first line being flexed or bent.

The first line 24 and the perforations 4 are arranged to meet t1=t, so that the one of the perforations 4 the closest to the end of the trailer 34 is given high resistance to deformation. Upon application of the force in the opposite rotational direction against curling tendency of the innermost turn of the photo filmstrip 2, the portions 9 at the first line 24 flex or bend as illustrated in FIG. 5B and absorb the force. According to the prior art, the conventional photo filmstrip is broken only upon small reverse rotation of the spool core 5 with occurrence of the gap L of FIG. 6. However the photo filmstrip 2 of the present invention is not broken even upon small reverse rotation of the spool core 5 with occurrence of the gap L. If the spool core 5 is rotated accidentally in the opposite rotational direction, the photo filmstrip 2 can be saved: upon discovering the accidental reverse rotation, the spool core 5 can be rotated in the winding direction. The photo filmstrip 2 is usable without breakage.

It is also possible in the present invention that corners Pa in FIG. 1 are cut away along fourth and fifth lines for gradual decrease of the width of the between the lateral edges 32 in a direction toward the first line 24. It is possible that sixth and seventh lines Pb are formed with a slow curvature having a radius R1 for gradual increase of the width of the retainer portion 3 toward the first line 24. The slow curvature R1 is slower than that of a conventional photo filmstrip. The curvatures of the corners Pa may be respectively formed according to a function $y=x^3$. A preferable radius R1 of the curvature of the sixth and seventh lines Pb is at least 5 mm.

It is to be noted that the corners Pa and the sixth and seventh lines Pb are formed at the same time as the retainer portion 3, upon the cutting operation of the photo filmstrip 2 from the continuous photo film 8. It is possible to form the sixth and seventh lines Pb upon the cutting operation of the photo filmstrip 2 from the continuous photo film 8, and later to cut to obtain the corners Pa.

Figure 7A:
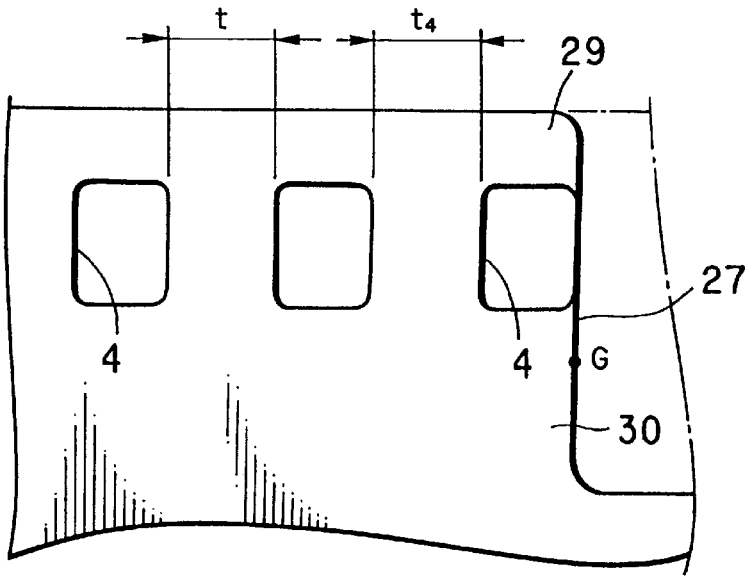
FIGS. 7A and 7B are partial plans illustrating another preferred photo filmstrip having the portion at a variant first line.
Figure 7B:
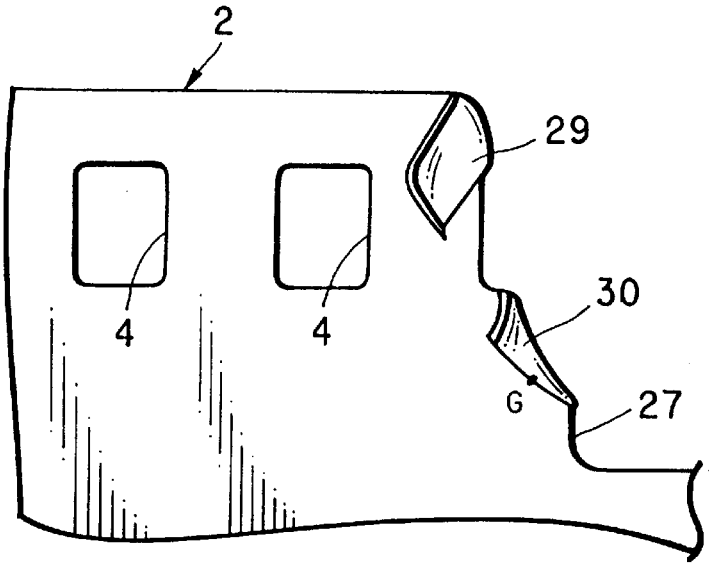
Figure 8A:
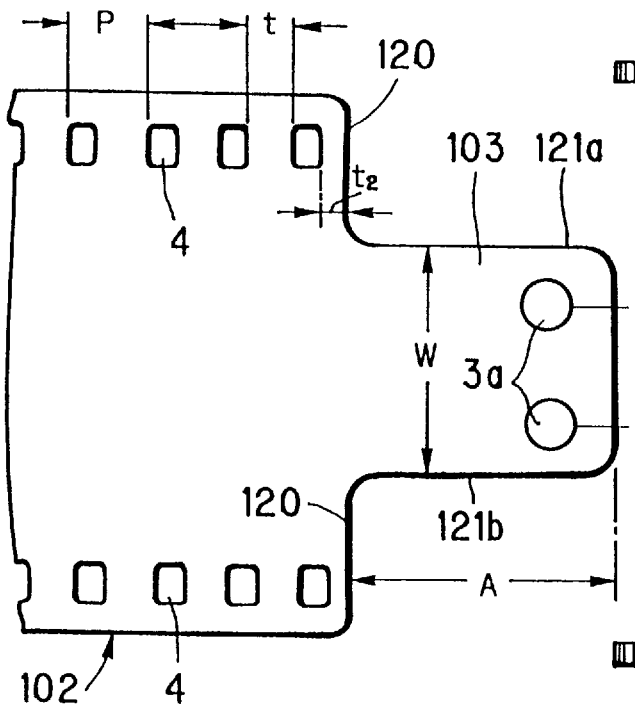
FIG. 8A (PRIOR ART)
FIG. 8 is a plan, partially cut away, illustrating a trailer of a photo filmstrip of the prior art with a spool.
Figure 8B:
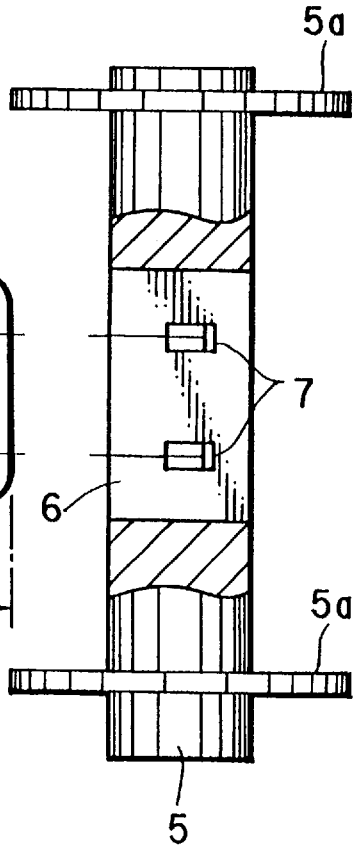
FIG. 8B (PRIOR ART)
Figure 9:
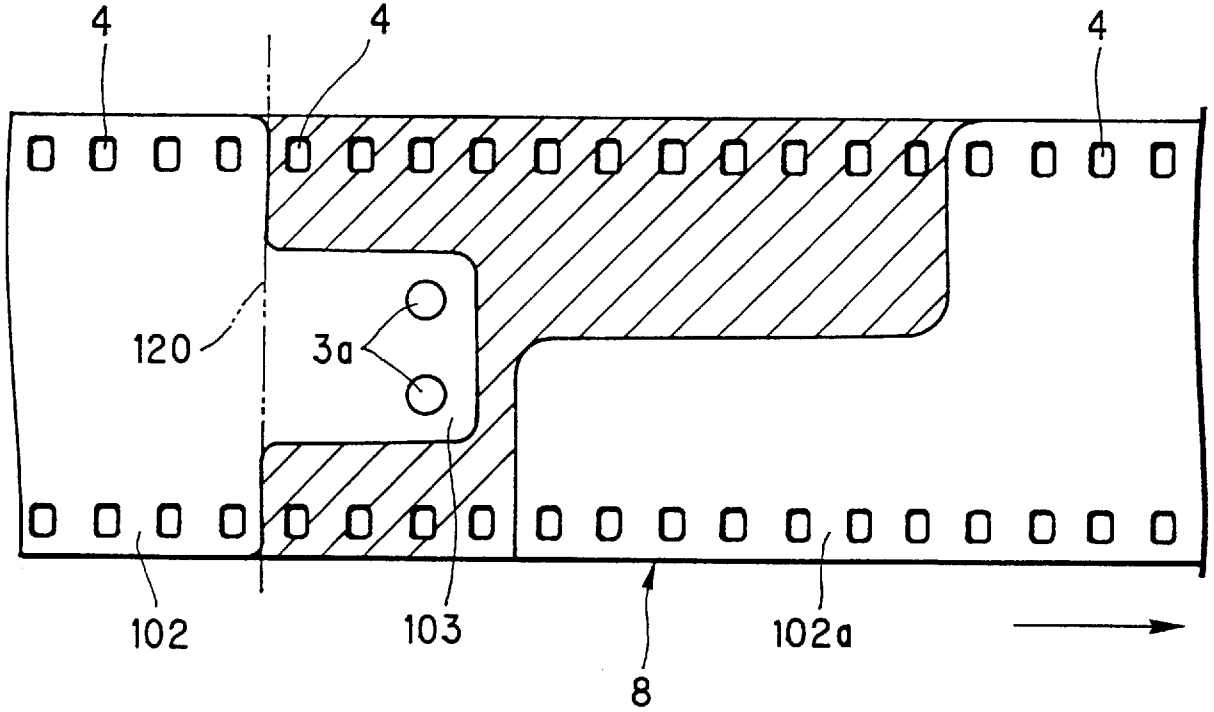
FIG. 9 (PRIOR ART)
FIG. 9 is a plan illustrating continuous photo film from which the trailer of the photo filmstrip is cut according to the prior art.
Figure 10A:
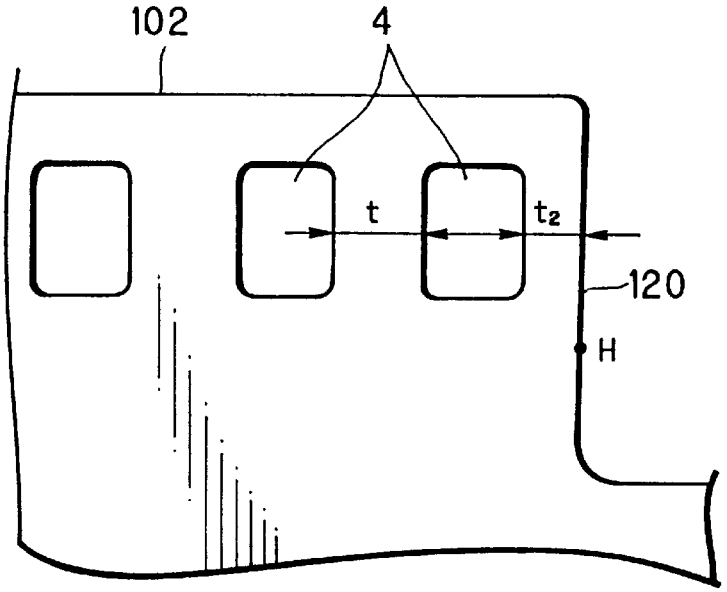
FIG. 10A (PRIOR ART)
FIG. 10A is a partial plan illustrating a portion of the conventional photo filmstrip at a first line for cutting.
Figure 10B:
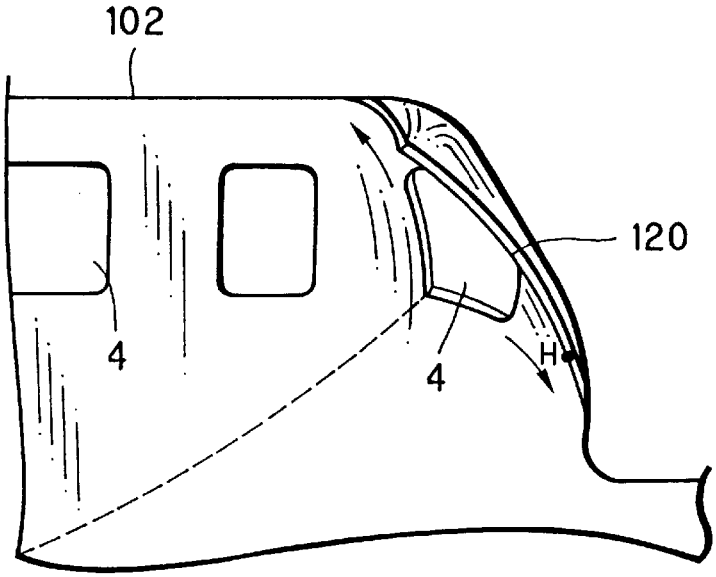
FIG. 10B (PRIOR ART)
FIG. 10B is a partial plan illustrating the portion at the first line being bent destructively according to the prior art.
Figure 11:
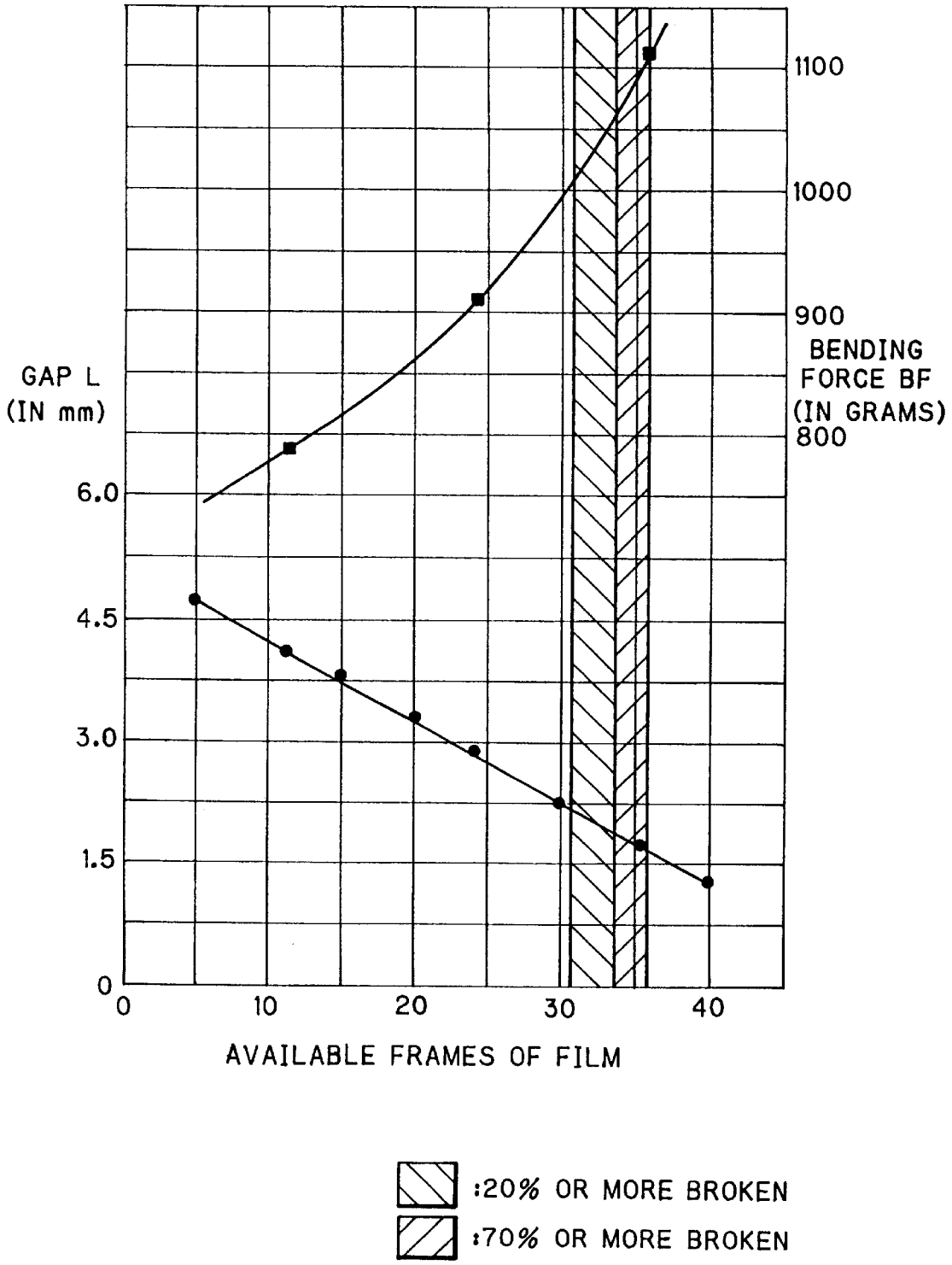
FIG. 11 (PRIOR ART)
FIG. 11 is a graph illustrating a condition of breakage of the conventional photo filmstrip upon reverse winding.

FIG. 7A illustrates another preferred embodiment of the present invention. A first line 27 is adapted to cut the photo filmstrip 2 from the continuous photo film 8, and, as edges of the trailer, is located to lie on one of sides of the perforations 4 the closer to the end of the trailer 34. After cutting the first line 27, the photo filmstrip meets t4=t, where t4 is an interval between a first one of the perforations 4 at the first line 27 and a second one of the perforations 4 succeeding to the first. When the spool core 5 is rotated opposite to the winding direction, a portion at a point G lying on the first line 27 is pushed on the open edge of the slot 6. In FIG. 7B, a narrow portion 29 and a corner portion 30 formed by the cutting absorb the strong force of bending in the opposite rotational direction. There occurs no stress sufficient for breaking the photo filmstrip 2.

Of course the present invention is also applicable to a photo filmstrip in which a first line is located transverse to one of the perforations, namely located between two sides of one perforation perpendicular to lateral edges 32. This meets t<t1<t+t3.

In the above embodiments, the slot 6 is used for retention of the retainer portion 3 to the spool core 5. The present invention is also applicable to a cassette which does not have the slot 6 and in which the retainer portion 3 is attached to the spool core 5 in a different manner, for example with an adhesive tape.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A photo filmstrip in which plural rectangular perforations are arranged along each of lateral edges and at a regular interval, said photo filmstrip being wound about a spool in a roll form with a trailer thereof wound inwards, said photo filmstrip comprising:

a retainer portion adapted to retention on said spool, formed at a smaller width in a substantially rectangular tab-like shape, by cutting said lateral edges of said trailer in an L-shape along first, second and third lines, said first line being substantially perpendicular to said lateral edges, said second and third lines being substantially parallel to said lateral edges, said first line lying along an edge of one of said perforations before forming said retainer portion by cutting along said lateral edges;

wherein said width of said retainer portion is increased toward said first line.

2. A photo filmstrip as defined in claim 1, wherein said retainer portion is adapted to be retained in insertion into a slot formed in said spool and to extend in an axial direction.

3. A photo filmstrip as defined in claim 2, wherein each of said perforations has first, second, third and fourth sides, said first and second sides are substantially perpendicular to said lateral edges, said third and fourth sides are substantially parallel to said lateral edges, and said first side lies nearer to said trailer than said second side.

4. A photo filmstrip as defined in claim 3, wherein said first line lies on said first side, and said one of said perforations defines a recess.

5. A photo filmstrip as defined in claim 3, wherein said first line lies on said second side, and said one of said perforations has been cut away.

6. A photo filmstrip as defined in claim 5, wherein two corners are defined between said first line and said lateral edges, and are cut down along fourth and fifth lines being inclined respectively with respect to said lateral edges with a decrease in a width of said trailer toward said first line.

7. A photo filmstrip as defined in claim 6, wherein said second line is connected to said first line via a sixth line, said third line is connected to said first line via a seventh line, said sixth and seventh lines are curved at a radius R1, and R1 ≧5 mm.

8. A photo filmstrip as defined in claim 2, further comprising at least one retaining hole, formed in said retainer portion, for receiving insertion of at least one retaining claw disposed in said slot.

9. A method of producing a photo filmstrip, said photo filmstrip having plural rectangular perforations arranged along each of lateral edges and at a regular interval, said photo filmstrip being wound about a spool in a roll form with a trailer thereof wound inwards, said photo filmstrip producing method comprising a step of:

cutting said photo filmstrip away from continuous photo film to provide said trailer with a retainer portion at a smaller width in a substantially rectangular tab-like shape, said retainer portion being formed by cutting said lateral edges of said trailer in an L-shape along first, second and third lines, said first line being substantially perpendicular to said lateral edges, said second and third lines being substantially parallel to said lateral edges, said first line lying along an edge of one of said perforations in said continuous photo film, said retainer portion being adapted to be inserted into a slot in said spool for retention.

10. A photo filmstrip producing method as defined in claim 9, wherein said trailer and said retainer portion are formed on a downstream side of said photo filmstrip with respect to a direction of consecutively handling said continuous photo film.

11. A photo filmstrip producing method as defined in claim 9, wherein each of said perforations has first, second, third and fourth sides, said first and second sides are substantially perpendicular to said lateral edges, said third and fourth sides are substantially parallel to said lateral edges, and said first side lies nearer to said trailer than said second side.

12. A photo filmstrip producing method as defined in claim 11, wherein said first line lies on said first side, and said one of said perforations defines a recess.

13. A photo filmstrip producing method as defined in claim 11, wherein said first line lies on said second side, and said one of said perforations has been cut away from said photo filmstrip.

14. A photo filmstrip producing method as defined in claim 13, wherein two corners are defined between said first line and said lateral edges, and are cut down along fourth and fifth lines being inclined respectively with respect to said lateral edges with a decrease in a width of said trailer toward said first line;

said width of said retainer portion is increased toward said first line, said second line is connected to said first line via a sixth line, said third line is connected to said first line via a seventh line, said sixth and seventh lines are cured at a radius R1, and R1≧5 mm.

* * * * *